US006807782B2

(12) United States Patent
Forman et al.

(10) Patent No.: US 6,807,782 B2
(45) Date of Patent: Oct. 26, 2004

(54) CAN SHIELD A SEMI-PERMANENT (REMOVABLE FOR MAINTENANCE PURPOSES) MODULAR WALL(S) OR MONUMENT(S) TO SHIELD FROM VIEW UNSIGHTLY UTILITY EQUIPMENT, INCLUDING BUT NOT LIMITED TO TRASH RECEPTACLES, POOL EQUIPMENT, AIR CONDITIONING/HEATING EQUIPMENT OR OTHER EXTERIOR/INTERIOR EQUIPMENT AND/OR APPLIANCES

(76) Inventors: James Lem Forman, 17517 E. San Marcus Dr., Fountain Hills, AZ (US) 85268; Darcy Lynn (Bock) Forman, 17517 E. San Marcus Dr., Fountain Hills, AZ (US) 85268

( * ) Notice: Subject to any disclaimer, the term of this patent is extended or adjusted under 35 U.S.C. 154(b) by 27 days.

(21) Appl. No.: 10/158,286

(22) Filed: May 30, 2002

(65) Prior Publication Data

US 2004/0016192 A1 Jan. 29, 2004

(51) Int. Cl.[7] ..... E02D 27/00

(52) U.S. Cl. ..... 52/293.1; 52/298; 40/607.1; 40/607.03; 40/611.01

(58) Field of Search ..... 52/169.1, 298, 52/293.1, 293.3, 309.7, 309.9, 309.12; 40/607.1, 611.01, 607.03, 607.06; 404/6; 256/19, 73, 24–25, 1

(56) References Cited

U.S. PATENT DOCUMENTS

| | | | | | |
|---|---|---|---|---|---|
| 4,875,622 | A | * | 10/1989 | Lents | 232/39 |
| 5,404,685 | A | * | 4/1995 | Collins | 52/309.7 |
| 5,588,272 | A | * | 12/1996 | Haponski | 52/309.12 |
| 5,625,988 | A | * | 5/1997 | Killick | 52/298 |
| 5,895,169 | A | * | 4/1999 | Holm et al. | 404/9 |
| 6,434,900 | B1 | * | 8/2002 | Masters | 52/283 |

* cited by examiner

*Primary Examiner*—Naoko Slack
(74) *Attorney, Agent, or Firm*—Frank J. McGue

(57) ABSTRACT

A decorative wall is disclosed which hides residential equipment. The decorative wall comprises a wall having a mounting mechanism which removably erects the wall on a surface, the wall having a flat surface indicia or images imprinted thereon.

5 Claims, 4 Drawing Sheets

CAN SHIELD A SEMI-PERMANENT (REMOVABLE FOR MAINTENANCE PURPOSES) MODULAR WALL(S) OR MONUMENT(S) TO SHIELD FROM VIEW UNSIGHTLY UTILITY EQUIPMENT, INCLUDING BUT NOT LIMITED TO TRASH RECEPTACLES, POOL EQUIPMENT, AIR CONDITIONING/HEATING EQUIPMENT OR OTHER EXTERIOR/INTERIOR EQUIPMENT AND/OR APPLIANCES

TECHNICAL FIELD

This invention relates generally to the field of decorative walls, and, more particularly, to decorative walls used to shield devices from view while enhancing aesthetics.

BACKGROUND OF THE INVENTION

The invention is a semipermanent, wall structure which shields from public view equipment such as trash disposal containers, pool equipment and the like. The invention is a decorative, removable and ornamental wall which greatly enhances the esthetic appearance by hiding the equipment and for minimal cost increases the value of the property on which it stands.

SUMMARY OF THE INVENTION

It is an object of the invention to provide a removable modular wall used to shield from public view such unsightly equipment as trash receptacles, pool equipment, air conditioning/heating equipment, commercial service entrance equipment, telephone or television equipment boxes or other exterior/interior equipment or appliances and the like.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWINGS

The present invention may be more readily described by reference to the accompanying drawings in which.

DESCRIPTION OF THE PREFERRED EMBODIMENT

Figure 1:
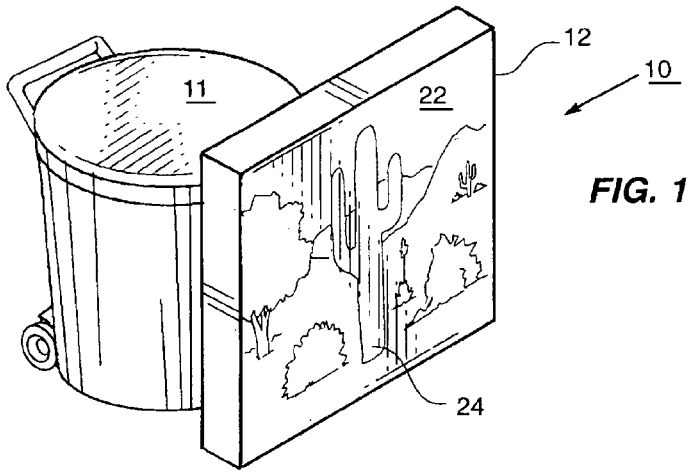
FIG. 1 is a top and front side perspective view of a wall used in the present invention to hide a garbage can.
Figure 2:
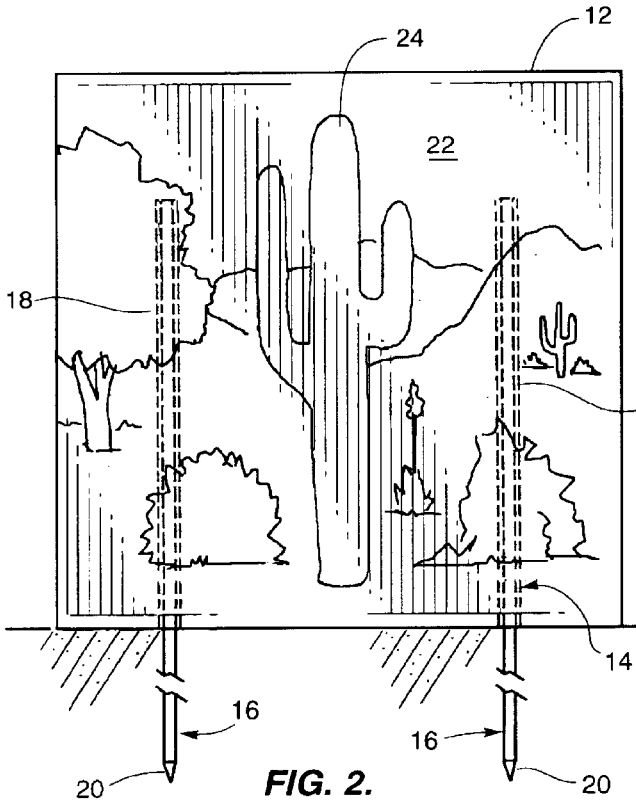
FIG. 2 is a front view of the wall of the embodiment of FIG. 1 with spikes used to mount said wall in the ground shown in shadow.
Figure 3:
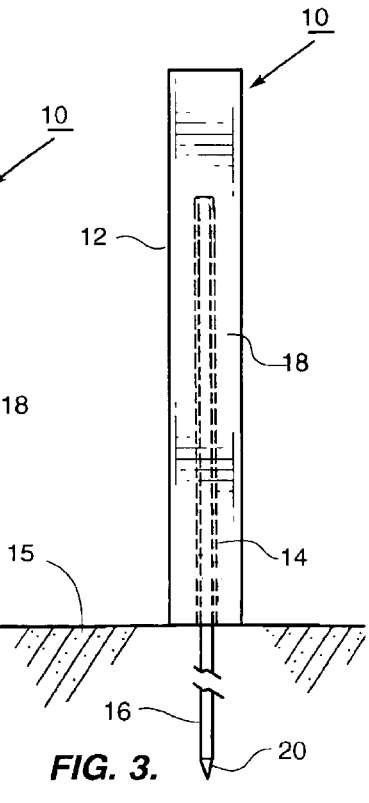
FIG. 3 is a side view of the wall of the embodiment of FIG. 1 with spikes used to mount said wall in the ground shown in shadow.

Referring more particularly to the drawings by characters of reference, FIGS. 1-3 disclose combinations of features which constitute the components of one embodiment of a decorative wall 10 of the present invention used to hide or screen equipment 11. Decorative wall 10 comprises a wall 12 having a mounting mechanism 14 which removably erects wall 12 on a surface 15, generally the ground. In the embodiment of FIGS. 1-3, mounting mechanism 14 comprises a pair of spikes 16 having a wall portion 18 contained within wall 12 and a spike portion 20 extending downwardly from wall 12. Spike portions 20 are driven into the ground to support decorative wall 10 in an upright position.

Equipment 11 in the illustrated embodiments is a trash disposal container. However, those skilled in the art will recognize that term equipment includes, but is not limited to, trash receptacles, pool equipment, air conditioning/heating equipment, commercial service entrance equipment, telephone or television equipment boxes or other exterior/interior equipment or appliances and the like.

In the preferred embodiment, decorative wall 10 further includes a flat surface 22 having indicia or images 24 imprinted thereon. In the illustrated embodiments of FIGS. 1-2, indicia or images 24 comprise a desert scene. Those skilled in the art will recognize that many other scenes are possible for indicia or images 24, including, but not limited to, seasonal themes such as Christmas, New Years, Halloween, Fourth of July, family scenes, sports themes, house numbers, business logos or any other such depictions.

Figure 4:
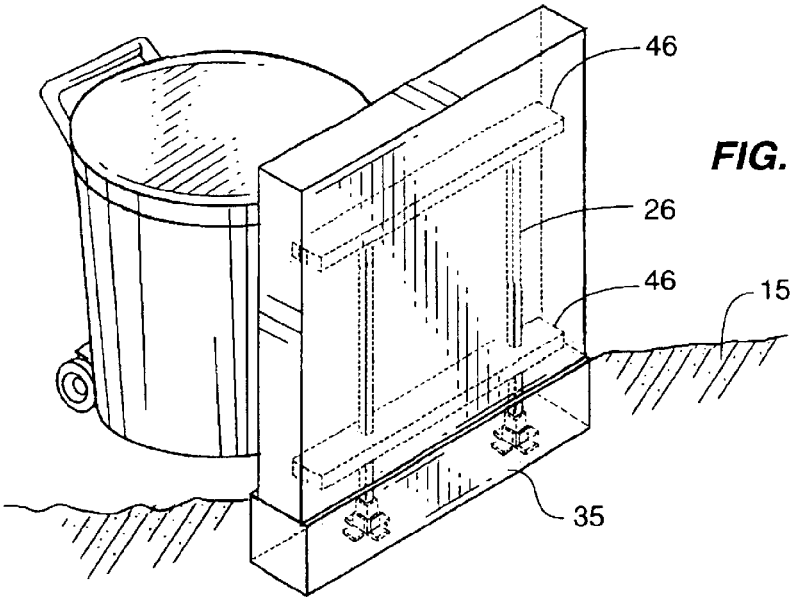
FIG. 4 is a top and front side perspective view view of an alternate embodiment of a wall used in the present invention to hide a garbage can with the mounting structure used to mount said wall in the ground shown in shadow.
Figure 5:
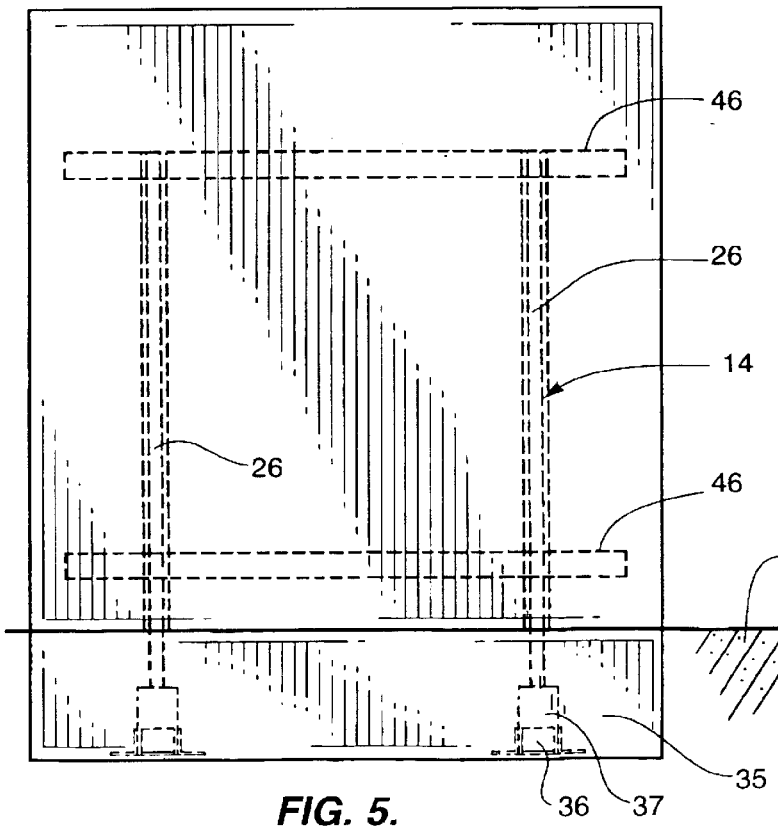
FIG. 5 is a front view of the wall of the embodiment of FIG. 4 with the mounting structure used to mount said wall in the ground shown in shadow.
Figure 6:
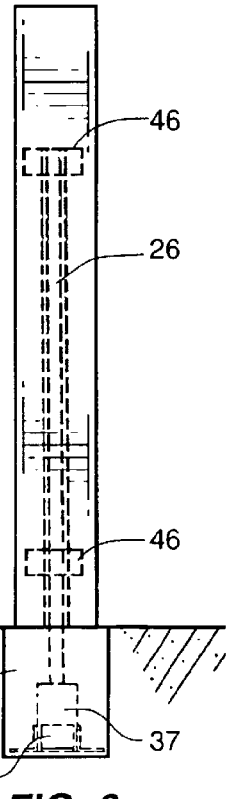
FIG. 6 is a side view of the wall of the embodiment of FIG. 4 with the mounting structure used to mount said wall in the ground shown in shadow.

FIGS. 4-6 illustrate an alternate embodiment of mounting mechanism 14 which comprises a pair of vertical posts 26 contained within wall 12. Those skilled in the art will recognize that the use of square tubing is for exemplary purposes and that other shapes, for example, round tubing, are suitable for use. Each vertical post 26 is slidably received within a corresponding channel piece 32 which extends from a tray 35. Tray 35, in turn, is buried under surface 15 whereby the top of tray 35 is coplanar with surface 15. Tray 35 is generally filled with a cementitious material 42 to anchor same in place.

Figure 9:
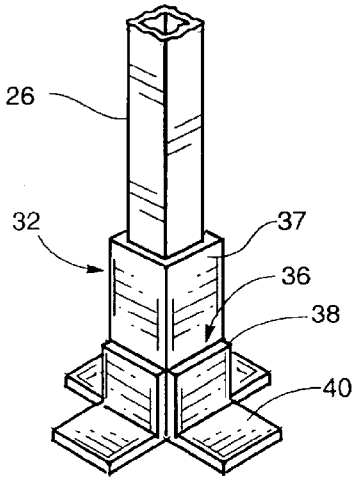
FIG. 9 is a perspective view of the mounting sleeve.
Figure 10:
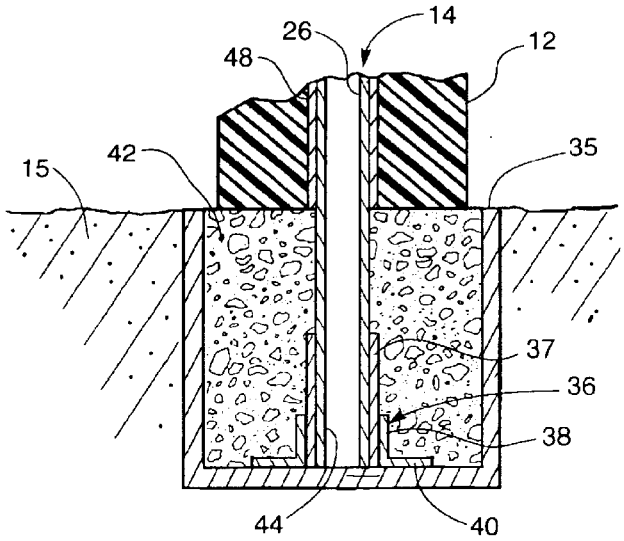
FIG. 10 is a side cross sectional view showing the mount of the wall in the ground.

As best seen in FIG. 9, each channel piece 32 comprises a square bracket 37 sized to snugly receive vertical post 26 therewithin. For purposes of illustration and not to limit the invention to the illustrated embodiment, square bracket 37 and vertical posts 26 are made from square tubing. On each of the four sides of bracket 37, an L-shaped bracket 36 is mounted having a vertical leg 38 affixed to a corresponding side of square bracket 37 and a horizontal leg 40 affixed to the bottom of tray 35. In some embodiments, a portion of square bracket 37 extends above ground 15 thereby allowing vertical post 26 to be slidably received therewithin. In other embodiments, vertical post 26 is permanently mounted within square bracket 37 and extends above ground to be slidably received within channels 48 discussed below.

In one embodiment best seen in FIGS. 4-6, a pair of horizontal beams 46 are contained within wall 12 to which vertical posts 26 are mounted. In one embodiment, beams 46 and vertical posts 26 comprise steel and are mounted to each other via welding. However, those skilled in the art will recognize that the cited example is for exemplary purposes only and not meant to limit the scope of the present invention to the particular embodiment disclosed herein.

Figure 7:
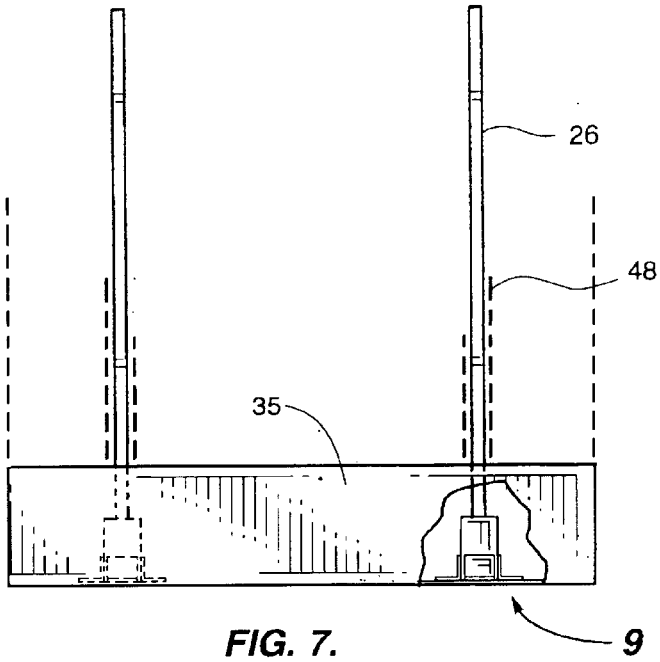
FIG. 7 is a partial cut away front view of an alternate mounting sleeve for the present invention.
Figure 8:
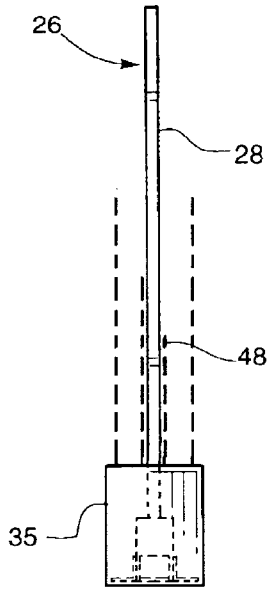
FIG. 8 is a side view of an alternate mounting sleeve (in shadow) for the present invention.

FIGS. 7 and 8 disclose another embodiment in which vertical posts 26 are permanently mounted to channel pieces 34. In this embodiment, vertical posts 26 are contained within tray 35 and extend upwardly therefrom. Vertical posts 26 are received within corresponding channels 48 extending from the bottom of wall 12 upwardly therein. In the embodiments of FIGS. 7 and 8, wall 12 is positioned whereby vertical posts 26 are aligned with channels 48 and slidably received therewithin. The weight of wall 12 prevents movement of same vertically while channels 48 in combination with vertical posts 26 prevent horizontal movement.

Figure 11:
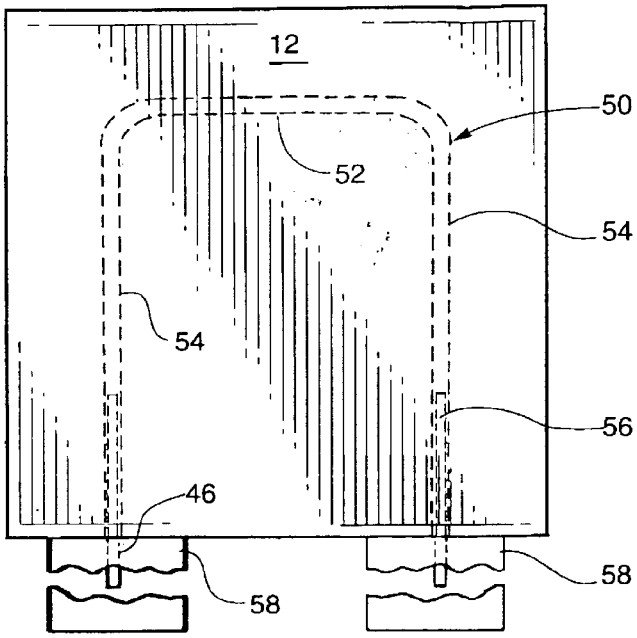
FIG. 11 is a front view of an alternate mounting structure in a wall shown in shadow.
Figure 12:
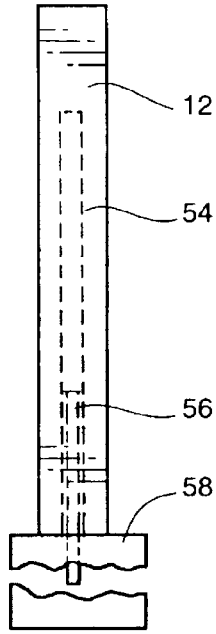
FIG. 12 is a side view of the alternate mounting structure of FIG. 11 in a wall shown in shadow.

FIGS. 11 and 12 show an alternate embodiment wherein an inverted U-shaped tubing 50 is contained within wall 12. U-shaped tubing 50 includes a base 52 and two legs 54 extending downwardly from said base. The distal ends of each leg 54 are coplanar with the bottom of wall 12 and are adapted to slidably receive two corresponding legs 56 extending upwardly from two footings 58. Footings 58 are similar to tray 35 but do not extend the length of wall 12.

Figure 13:
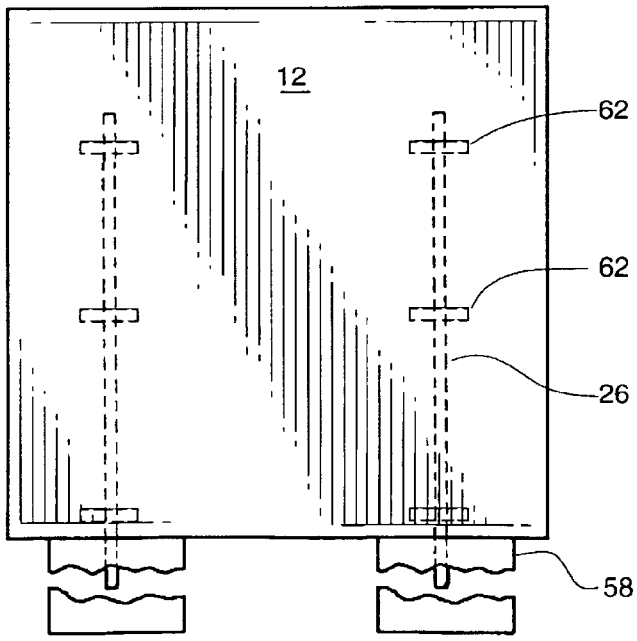
FIG. 13 is a front view of still another alternate mounting structure in a wall shown in shadow.
Figure 14:
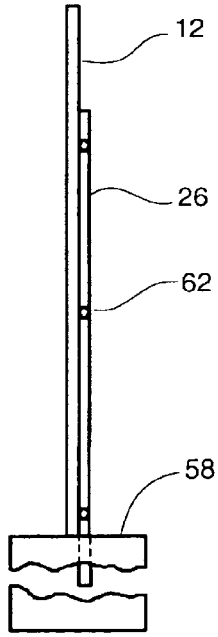
FIG. 14 is a side view of the alternate mounting structure of FIG. 13 shown in shadow.

FIGS. 13 and 14 show still another embodiment wherein vertical posts 26 extend upwardly from footings 58. In addition to the use of footings 58 instead of tray 35, vertical posts 26 are mounted to mounting brackets 62 positioned on one exterior side of wall 12, preferably the side facing away from the street. Vertical posts 26 can simply be slidably received within mounting brackets 62, or more strongly affixed via screws or nuts and bolts as desired.

In use, decorative wall 10 is positioned to block the view of passing persons of equipment the user desires to hide. Indicia or images 24 are positioned on the outer wall of the decorative wall to provide an aesthetically pleasing view to the passing persons. In addition, the removable feature allows the user to change the indicia or images as desired. For example, the user can use themed images to augment Halloween, Thanksgiving or Christmas decorations as desired.

Although only certain embodiments have been illustrated and described, it will be apparent to those skilled in the art that various changes and modifications may be made therein without departing from the spirit of the invention or from the scope of the appended claims.

What is claimed is:

1. A decorative wall for hiding residential equipment comprises a wall having a mounting mechanism which removably erects the wall on a surface, the mounting mechanism comprising:

two or more vertical posts, each vertical post contained by the wall, a tray having a two or more channel pieces mounted therein, each channel piece extending upwardly from the tray, each channel piece corresponding to one of the two more vertical posts, each channel piece being positioned and adapted to slidably receive the corresponding vertical post, the tray being buried under the surface, and the wall having a flat surface having indicia or images imprinted thereon.

2. The decorative wall as set forth in claim 1 wherein the top of the tray is coplanar with the surface.

3. The decorative wall as set forth in claim 1 wherein the tray is filled with a cementitious material thereby anchoring said tray in place, the cementitious material having a channel aligned with the vertical post thereby allowing the vertical post to be slidably received in said channel.

4. The decorative wall as set forth in claim 1 wherein each channel piece comprises a tube sized to snugly receive the vertical post, the channel piece further having brackets mounting said tube to the bottom of the tray.

5. The decorative wall as set forth in claim 1 having a pair of horizontal beams contained within the wall, the two or more vertical posts being mounted to the pair of horizontal beams.

* * * * *